US010940702B2

(12) United States Patent
Profaca

(10) Patent No.: US 10,940,702 B2
(45) Date of Patent: Mar. 9, 2021

(54) INTEGRATED INKJET MODULE FOR SCALABLE PRINTER

(71) Applicant: MEMJET TECHNOLOGY LIMITED, Dublin (IE)

(72) Inventor: Mark Profaca, North Ryde (AU)

(73) Assignee: Memjet Technology Limited

( * ) Notice: Subject to any disclaimer, the term of this patent is extended or adjusted under 35 U.S.C. 154(b) by 0 days.

(21) Appl. No.: 16/592,676

(22) Filed: Oct. 3, 2019

(65) Prior Publication Data

US 2020/0108647 A1 Apr. 9, 2020

Related U.S. Application Data

(60) Provisional application No. 62/742,135, filed on Oct. 5, 2018.

(51) Int. Cl.

| | |
|---|---|
| ***B41J 11/00*** | (2006.01) |
| ***B41J 29/02*** | (2006.01) |
| ***B41J 2/165*** | (2006.01) |
| ***B41J 25/304*** | (2006.01) |
| ***B41J 29/06*** | (2006.01) |

(52) U.S. Cl.

CPC ..... *B41J 11/006* (2013.01); *B41J 2/16505* (2013.01); *B41J 2/16535* (2013.01); *B41J 2/16547* (2013.01); *B41J 2/16585* (2013.01); *B41J 25/304* (2013.01); *B41J 29/02* (2013.01); *B41J 29/06* (2013.01); *B41J 2202/20* (2013.01)

(58) Field of Classification Search

CPC ..... B41J 2/16588

See application file for complete search history.

(56) References Cited

U.S. PATENT DOCUMENTS

| | | | |
|---|---|---|---|
| 10,005,299 B2 | 6/2018 | Profaca et al. | |
| 2008/0192077 A1 | 8/2008 | Middleton et al. | |
| 2018/0001644 A1* | 1/2018 | Hirosawa | B41J 2/16508 |

FOREIGN PATENT DOCUMENTS

| | | |
|---|---|---|
| GB | 2 484 418 A | 4/2012 |
| JP | H-03-129345 A | 6/1991 |

OTHER PUBLICATIONS

International Search Report dated Dec. 12, 2019, for PCT Application No. PCT/EP2019/074752, filed on Sep. 16, 2019, 4 pages.

Written Opinion of the International Searching Authority dated Dec. 12, 2019, for PCT Application No. PCT/EP2019/074752, filed on Sep. 16, 2019, 8 pages.

* cited by examiner

*Primary Examiner* — Julian D Huffman

(74) *Attorney, Agent, or Firm* — Cooley LLP

(57) ABSTRACT

An integrated inkjet module includes: a support chassis configured for fixedly mounting on a media feed chassis; a maintenance chassis slidably mounted on the support chassis; and a print bar chassis liftably mounted on the maintenance chassis, the print bar chassis having one or more inkjet printheads mounted thereon.

15 Claims, 9 Drawing Sheets

INTEGRATED INKJET MODULE FOR SCALABLE PRINTER

CROSS-REFERENCE TO RELATED APPLICATIONS

The present application claims the benefit of priority under 35 U.S.C. § 119(e) of U.S. Provisional Application No. 62/742,135, entitled INTEGRATED INKJET MODULE FOR SCALABLE PRINTER, filed Oct. 5, 2018, the contents of which are hereby incorporated by reference in their entirety for all purposes.

FIELD OF THE INVENTION

This invention relates to a print engine and integrated inkjet modules for a digital inkjet press. It has been developed primarily for integrating an array of inkjet modules into a low-cost digital inkjet press suitable for short-run print jobs.

BACKGROUND OF THE INVENTION

Inkjet printers employing Memjet® technology are commercially available for a number of different printing formats, including desktop printers, digital inkjet presses and wideformat printers. Memjet® printers typically comprise one or more stationary inkjet printhead cartridges, which are user-replaceable. For example, a desktop label printer comprises a single user-replaceable multi-colored printhead cartridge, a high-speed label printer comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

U.S. Pat. No. 10,076,917, the contents of which are incorporated herein by reference, describes a commercial pagewide printing system comprising an N×M two-dimensional array of print modules and corresponding maintenance modules. Providing OEM customers with the flexibility to select the dimensions and number of printheads in an N×M array in a modular, cost-effective kit form enables access to a wider range of commercial digital printing markets that are traditionally served by offset printing systems.

Nevertheless, it is still desirable to simplify integration of modules into a scalable pagewide array. Simplifying integration of modules shortens the development time and lowers costs for OEMs wishing to commercialize digital inkjet presses.

SUMMARY OF THE INVENTION

In a first aspect, there is provided an inkjet module comprising:

a support chassis configured for fixedly mounting on a media feed chassis;

a maintenance chassis slidably mounted on the support chassis; and a print bar chassis liftably mounted on the maintenance chassis, the print bar chassis having one or more inkjet printheads mounted thereon.

The inkjet module according to the first aspect advantageously allows construction of printers with user access to printheads and maintenance consumables for replacement, as well as access to the media feed path for cleaning, clearing jams etc. Moreover, the inkjet module is a single, integrated unit configured for dropping in to an existing media feed chassis with minimal modifications required.

Preferably, the support chassis has a base defining notches configured for mounting the inkjet module on fixed roller shafts of the media feed chassis.

Preferably, each notch has a respective clamp for clamping the support chassis fast with the roller shafts.

Preferably, the support chassis comprises one or more spittoons for receiving spitted ink from the printheads.

Preferably, the support chassis comprises a plurality of datums for datuming against the print bar chassis.

Preferably, the print bar chassis comprises a plurality of pins projecting towards the datums of the support chassis.

Preferably, the pins are height-adjustable.

Preferably, the print bar chassis is fast with the maintenance chassis in a slide direction of the maintenance chassis.

Preferably, the maintenance chassis comprises one or more maintenance modules corresponding to the one or more printheads of the print bar chassis.

Preferably, the maintenance chassis is mounted to the support chassis via a bidirectional slide mechanism.

Preferably, the maintenance chassis comprises a catch for locking the maintenance chassis and print bar chassis in a printing position.

Preferably, the print bar chassis is fast with the maintenance chassis in a slide direction of the maintenance chassis.

Preferably, the print bar chassis comprises a handle for effecting sliding movement of the maintenance chassis.

In a second aspect, there is provided a printing system comprising:

a media feed chassis including a plurality of fixed roller shafts, each roller shaft having a rotatable roller for guiding print media through a media feed path; and one or more inkjet modules mounted on the media feed chassis for printing on the print media, each inkjet module having a support chassis seated on a set of roller shafts, wherein the support chassis comprises a base having a set of notches defined therein, the roller shafts being received within the notches.

The printing system according to the second aspect advantageously employs fixed roller shafts on the media feed chassis as a support for inkjet modules. This design obviates overhead gantries for mounting print engines as well as allowing accurate control of printhead-paper-spacing (PPS) via registration with the roller shafts.

In a related aspect, there is also provided an integrated inkjet module comprising:

a support chassis configured for seating on a set of roller shafts, the support chassis comprising a base having a set of notches for receiving the roller shafts and corresponding clamps for clamping the roller shafts in the notches; and one or more printheads operatively positioned relative to the support chassis for printing on print media fed through the support chassis.

Preferably, the rollers are positioned for guiding a web of print media through a curved media path.

Preferably, one of set of roller shafts comprises a pair of roller shafts, the pair of roller shafts being received within a complementary notches defined in the base of a respective support chassis.

Preferably, each notch has a corresponding clamp for clamping the inkjet module fast with the roller shafts.

Preferably, each inkjet module further comprises:

a maintenance chassis mounted on the support chassis; and a print bar chassis mounted on the maintenance chassis, the print bar chassis having one or more inkjet printheads mounted thereon.

Preferably, the print bar chassis is liftable relative to the support chassis.

Preferably, the maintenance chassis is laterally slidable relative to the support chassis.

Preferably, the support chassis comprises one or more spittoons for receiving spitted ink.

Preferably, the support chassis comprises a plurality of datums for datuming against a print bar chassis.

In a third aspect, there is provided an integrated inkjet module comprising:

a support chassis configured for fixedly mounting on a media feed chassis;

a maintenance chassis mounted on the support chassis; and a print bar chassis liftably mounted on the maintenance chassis, the print bar chassis having one or more printheads mounted thereon, wherein the print bar chassis comprises datum pins maximally spaced apart at each corner thereof, each datum pin engaging with a complementary datum surface of the support chassis to control a separation between the printheads and a media feed path during printing.

The inkjet module according to the third aspect advantageously maximizes separation of datums controlling PPS, thereby improving PPS accuracy.

Preferably, the datum pins are adjustable for varying the separation between the printheads and the media feed path.

Preferably, each datum pin is mounted on a lug projecting outwardly from each corner of the print bar chassis.

Preferably, the print bar chassis comprises a frame and first and second pairs of opposed legs extending downwardly from respective first and second ends of the frame, each leg having a set of roller bearings configured for bearing against a respective guide rail of the maintenance module, and wherein opposed roller bearings are positioned between a respective pair of datum pins.

Preferably, each leg comprises an outwardly projecting lug, each datum pin being mounted on a respective lug.

Preferably, an hydraulic piston mechanism interconnects the print bar chassis and maintenance chassis for lifting and lowering the print bar chassis relative to the support chassis.

Preferably, a pair of hydraulic piston mechanisms are positioned at opposite ends of the inkjet module, the pair of hydraulic piston mechanisms being controlled by a common hydraulic system for synchronous movement.

In a fourth aspect, there is provided an integrated inkjet module comprising:

a print bar chassis including: an elongate frame mounting one or more printheads; and first and second pairs of opposed legs extending downwardly from respective first and second ends of the frame, each leg having a set of roller bearings configured for bearing against a respective guide rail of the inkjet module;

a support chassis configured for fixedly mounting on a media feed chassis; and a lift mechanism for lifting the print bar chassis relative to the support chassis.

The inkjet module according to the fourth aspect advantageously provides accurate and stable control of print bar lifting along a nominal z-axis, minimizing skew and misalignments in both x- and y-axes perpendicular to the z-axis.

Preferably, the first and second pairs of opposed legs are positioned between respective first and second pairs of datum pins.

Preferably, each leg comprises an outwardly projecting lug, each datum pin being mounted on a respective lug.

Preferably, each pair of opposed legs has a respective set of roller bearings bearing against opposite surfaces of respective guide rails.

Preferably, each roller bearing is grooved for receiving part of a respective guide rail.

In a fifth aspect, there is provided an inkjet printing assembly comprising:

a support chassis having a plurality of datum surfaces; and a print bar chassis liftably mounted on the support chassis, the print bar chassis having one or more printheads mounted thereon and a plurality of datum pins for engagement with the datum surfaces;

a lift mechanism for moving the print bar chassis between a lowered position in which the datum pins are engaged with the datum surfaces and a raised position in which the datums pins are spaced apart from the datum surfaces; and one or more magnets for urging the print bar chassis towards the support chassis.

The inkjet printing assembly ("inkjet module") according to the fifth aspect advantageously provides secure datuming of a print bar chassis with a support chassis when lowering the print bar chassis from a raised position (e.g. maintenance position) to a lowered position (e.g. printing position). In particular, it enables gentle lowering of the print bar chassis whilst providing a strong force when required for secure datuming.

Preferably, each magnet is adjustably mounted on the print bar chassis.

Preferably, the support chassis comprises one or more ferromagnetic pads aligned with the magnets.

Preferably, in the lowered position, a separation between each magnet and each corresponding ferromagnetic pad is less than 2 mm.

Preferably, the datum pins are adjustable for varying a separation between the printheads and a media feed path in the lowered position.

Preferably, the magnets are rare-earth magnets.

Preferably, the lift mechanism is selected from the group consisting of: a wire and pulley mechanism, an hydraulic mechanism, a rack-and-pinion mechanism and a scissor mechanism.

It will be appreciated that, where applicable, preferred features described in connection with one aspect are equally applicable to all aspects described herein.

As used herein, the term "ink" is taken to mean any printing fluid, which may be printed from an inkjet printhead. The ink may or may not contain a colorant. Accordingly, the term "ink" may include conventional dye-based or pigment-based inks, infrared inks, fixatives (e.g. pre-coats and finishers), 3D printing fluids, biological fluids and the like.

As used herein, the term "mounted" includes both direct mounting and indirect mounting via an intervening part.

BRIEF DESCRIPTION OF THE DRAWINGS

One embodiment of the present invention will now be described by way of example only with reference to the accompanying drawings, in which.

DETAILED DESCRIPTION OF THE INVENTION

Modular Inkjet Press

Figure 1:
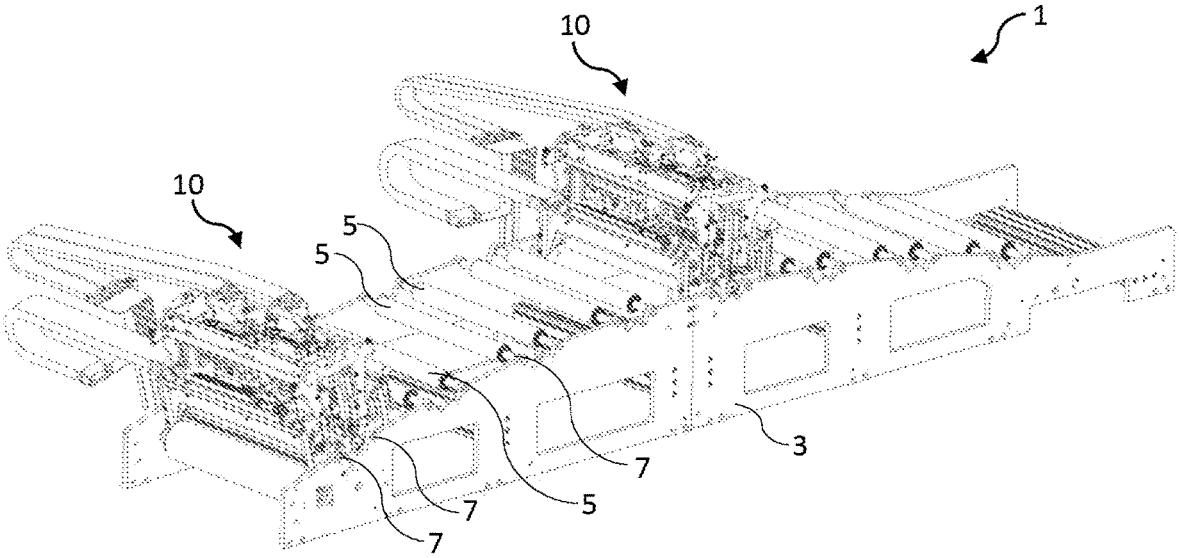
FIG. 1 is a front perspective view of a digital inkjet press including multiple inkjet modules.
Figure 2:
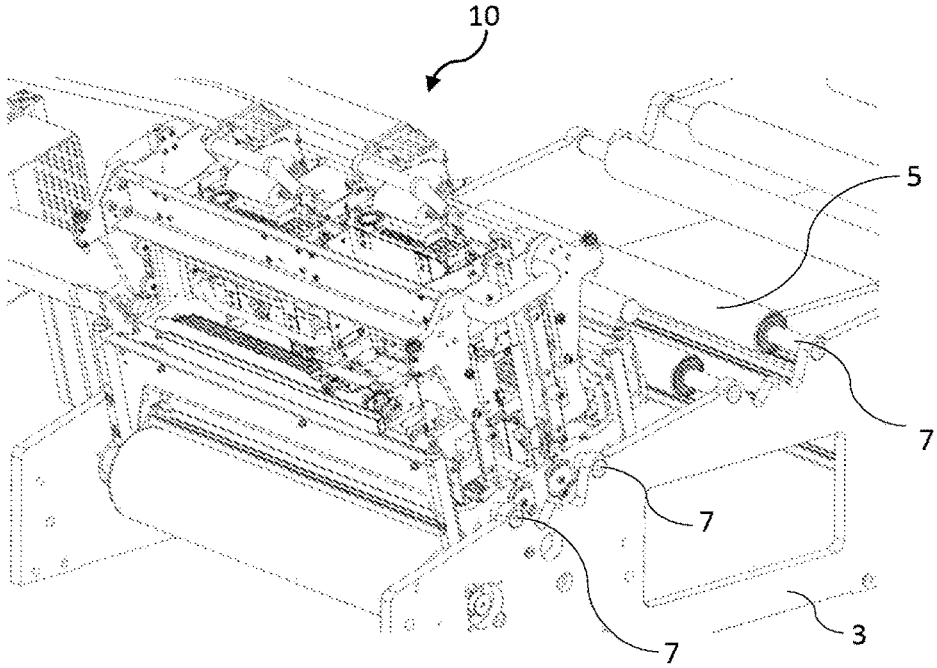
FIG. 2 is a magnified view of one inkjet module in the digital inkjet press.

Referring to FIG. 1, there is shown a printer 1 configured for use as a web-based printing system, such as a digital inkjet press. The printer 1 comprises a media feed chassis 3 having a series of rollers 5 mounted on roller shafts 7 fixed to the media feed chassis. The rollers 5 are arranged in pairs and define an convexly curved media feed path for feeding a web of print media (not shown) past multiple printheads. The web is tensioned over the rollers 5 and fed past the printheads using a suitable web-feed mechanism (not shown) as known in the art.

The printer 1 comprises multiple pagewide inkjet modules 10 spaced apart and aligned with each other along a media feed direction. Each inkjet module 10 extends across a full width of the media feed path and comprises one or more inkjet printheads configured for printing onto a media web in a single pass. Typically, each inkjet module 10 is configured for printing a single color of ink. In the embodiment shown, the media feed chassis 3 is configured for supporting eight inkjet modules 10 (one inkjet module per pair of rollers 5), although only two modules are shown in FIG. 1 for clarity. Multiple aligned inkjet modules 10 provides users with the facility to print cyan, magenta, yellow and black inks, as well as various spot colors for specialized color printing.

Nevertheless, it will of course be appreciated that other arrangements of one or more inkjet modules 10 are within the ambit of the present invention. For example, fewer modules may be employed in some printers for standard color printing (CMYK) or monochrome printing (K only).

Inkjet Module 10

Each inkjet module 10 is a fully integrated module designed to be "dropped in" to the media feed chassis 3 for scalable construction of a digital inkjet press. Alternatively, an existing analogue press may be converted to a digital press by dropping in the inkjet modules 10 with relatively few changes to an existing media feed chassis and web feed mechanism. Thus, the inkjet modules 10 are designed for seamless integration with a custom-built or existing web feed system, thereby minimizing development costs for OEMs.

Figure 3:
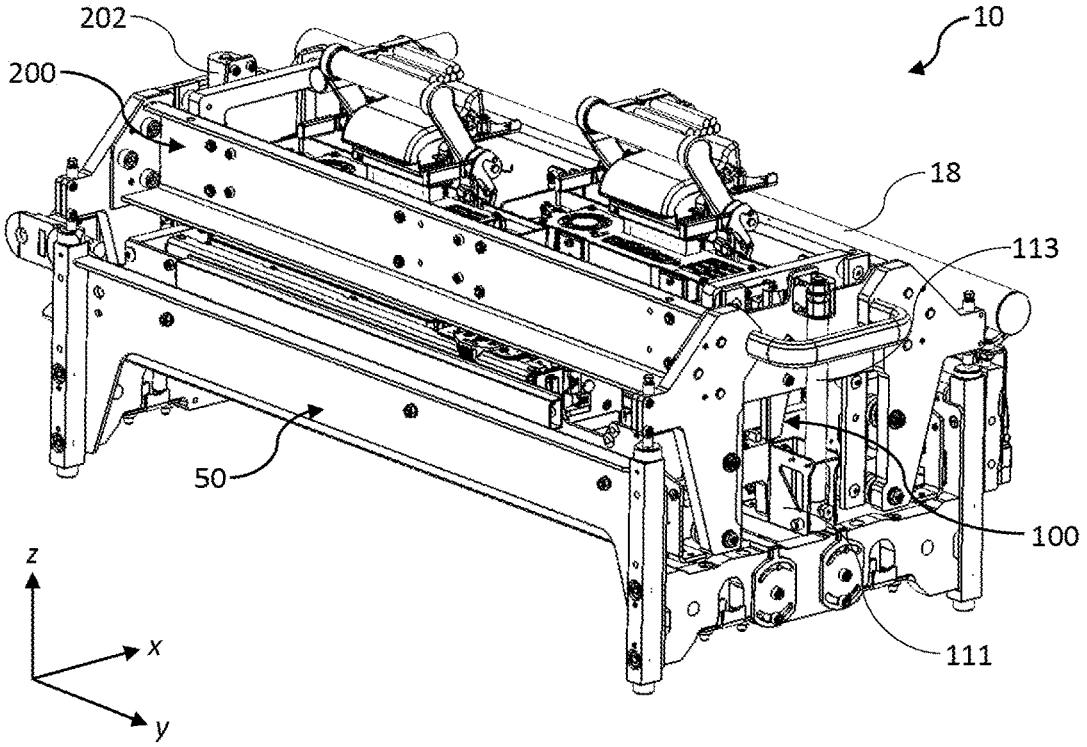
FIG. 3 is a first side perspective of an inkjet module in isolation.
Figure 4:
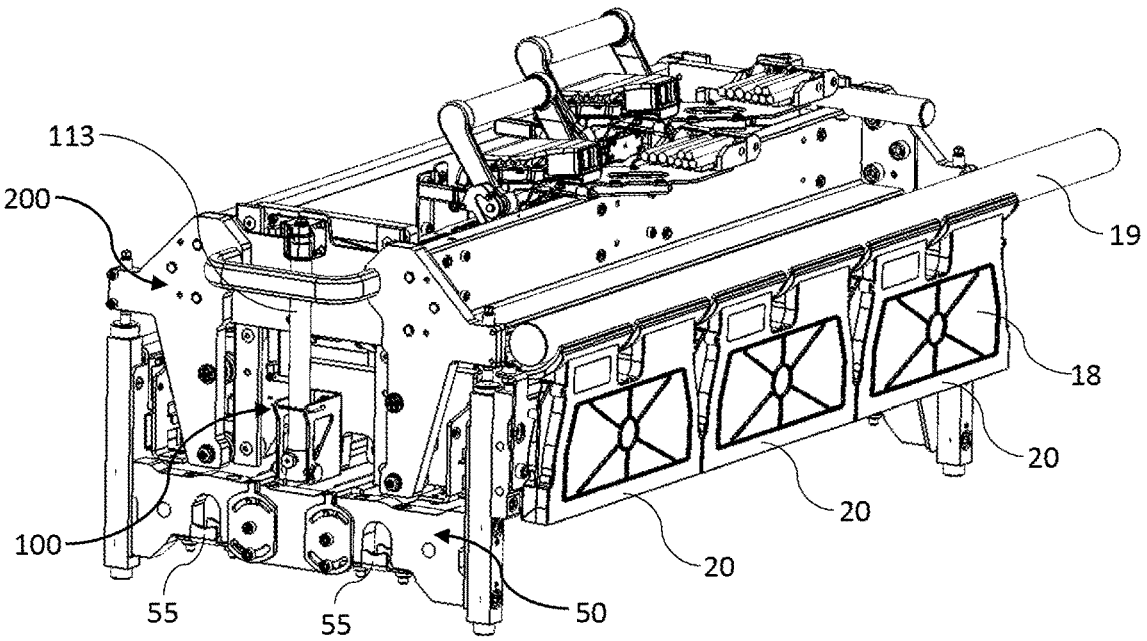
FIG. 4 is a second side perspective the inkjet module shown in FIG. 3.

The inkjet module 10, shown in isolation in FIGS. 3 and 4, comprises three main chassis: a support chassis 50 for fixed mounting onto the media feed chassis 3; a maintenance chassis 100 slidably mounted on the support chassis; and a print bar chassis 200 liftably mounted on the maintenance chassis. As best shown in FIG. 4, each inkjet module 10 additionally comprise an aerosol collector 18 fixed to the support chassis 50 for collecting ink mist and other particulates generated during high-speed printing. The aerosol collector 18 is generally modular to enable aerosol collectors of different lengths to be readily manufactured. As shown in FIG. 4, the aerosol collector 18 comprises an elongate vacuum tube 19 and multiple (e.g. three) modular nozzle units 20 slotted into the vacuum tube.

Figure 5:
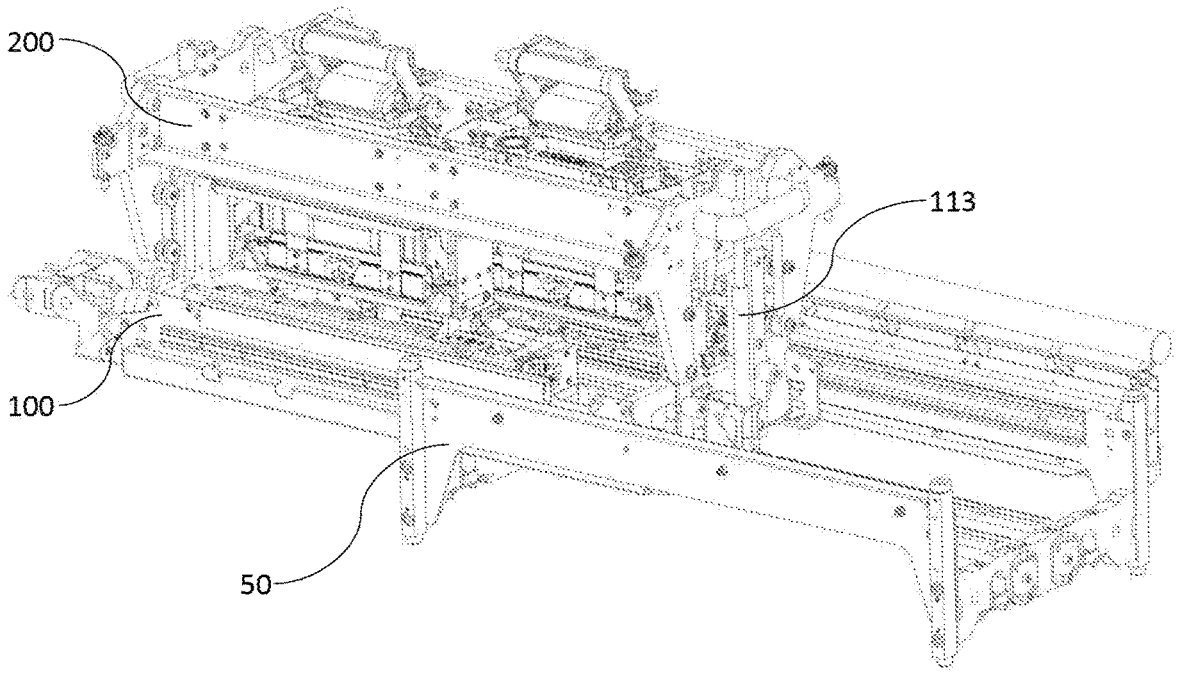
FIG. 5 is a side perspective of the inkjet module with the maintenance and print chassis slid rearwards.
Figure 6:
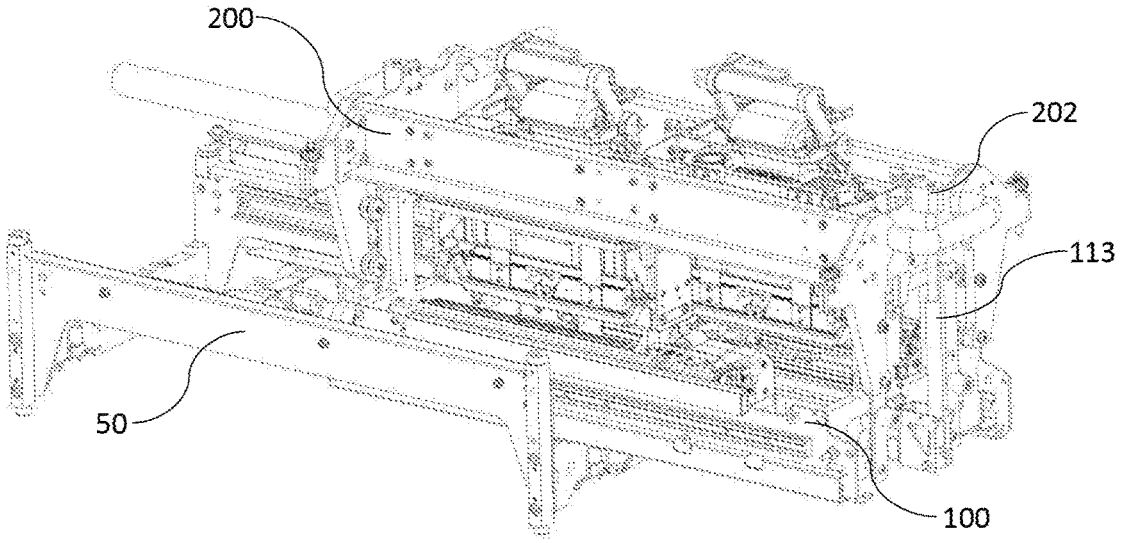
FIG. 6 is a side perspective of the inkjet module with the maintenance and print chassis slid forwards.

Referring to FIGS. 5 and 6, the maintenance chassis 100 is mounted on the support chassis 50 for bidirectional lateral sliding relative to the support chassis. As shown in FIG. 5, the maintenance chassis 100 and attached print bar chassis 200 have been pushed rearwards away from a user in a first direction perpendicular to the media feed direction. In this configuration, the user has ready access to the rollers 5 and media feed path for threading media, cleaning rollers, clearing jams etc. As shown in FIG. 6, the maintenance chassis 100 and attached print bar chassis 200 have been pulled forwards towards a user in a second direction perpendicular to the media feed direction. In this configuration, the user has ready access to hardware consumables (e.g. printheads, wipers) for replacement when required. Thus, the bidirectional sliding mechanism conveniently allows users to access different components from one side of the printer 1.

In FIGS. 5 and 6, the print bar chassis 200 is shown in its raised position; in FIGS. 3 and 4, the print bar chassis 200 is shown in its lowered position for printing. U.S. Pat. No. 10,076,917 describes in detail a print bar chassis that is liftable relative to a maintenance chassis for printing and maintenance operations. It will be appreciated by those skilled in the art that the print bar chassis 200 and maintenance chassis 100 described herein are similar in function to the arrangement described in U.S. Pat. No. 10,076,917.

Figure 7:
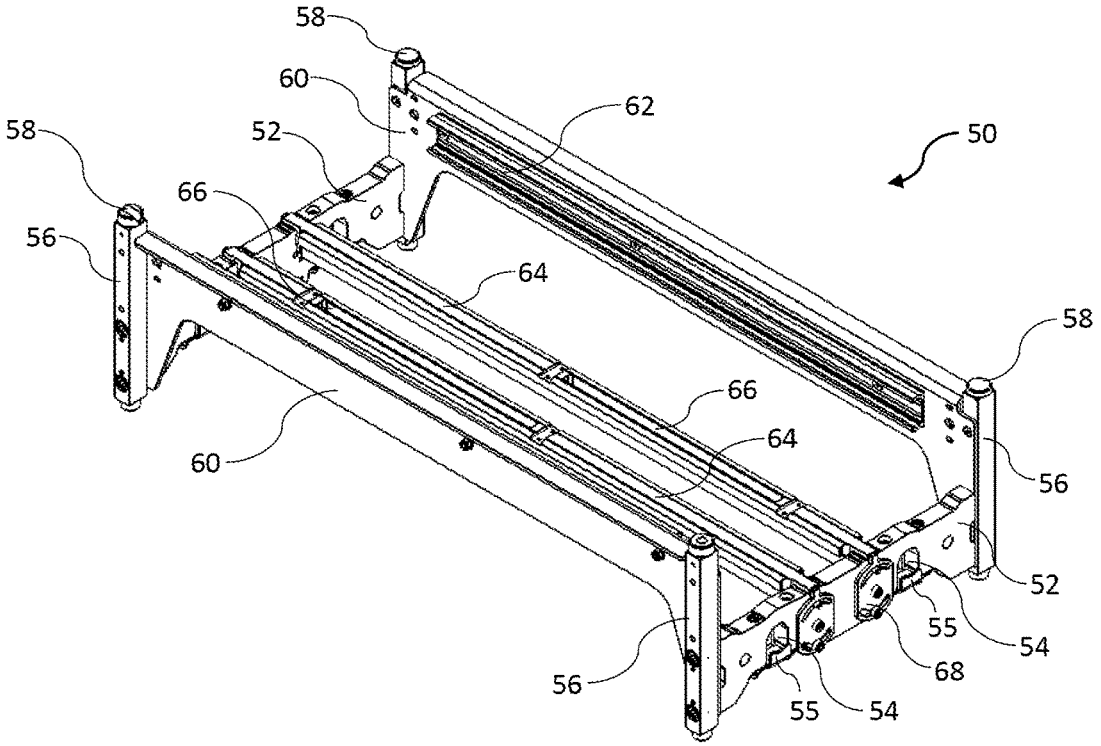
FIG. 7 is a perspective view of a support chassis in isolation.

Turning now to FIG. 7, the support chassis 50 is shown in isolation. The support chassis 50 is configured for convenient integration of the inkjet module 10 with the media feed chassis 3, as well as enabling relative sliding movement of the maintenance chassis 100. The support chassis 50 takes the form of an elongate rectangular frame comprising a pair of opposite base plates 52 defining a base thereof. Each base plate 52 has a pair of notches 54 defined therein for receiving a complementary pair of roller shafts 7 of the media feed chassis 3. The notches 54 each have a removable clamp 55 for clamping the support chassis 50 fast with the roller shafts 7. Thus, each inkjet module 10 is configured for seating on a pair of roller shafts 7 of the media feed chassis 3, thereby enabling facile "drop-in" construction of the printer 1. The media feed chassis 3 is preferably constructed (or, alternatively, suitably modified) such that each pair of roller shafts 7 is positioned and spaced apart for alignment with the notches 54 defined in the base plates 52 of the support chassis 50.

Figure 8:
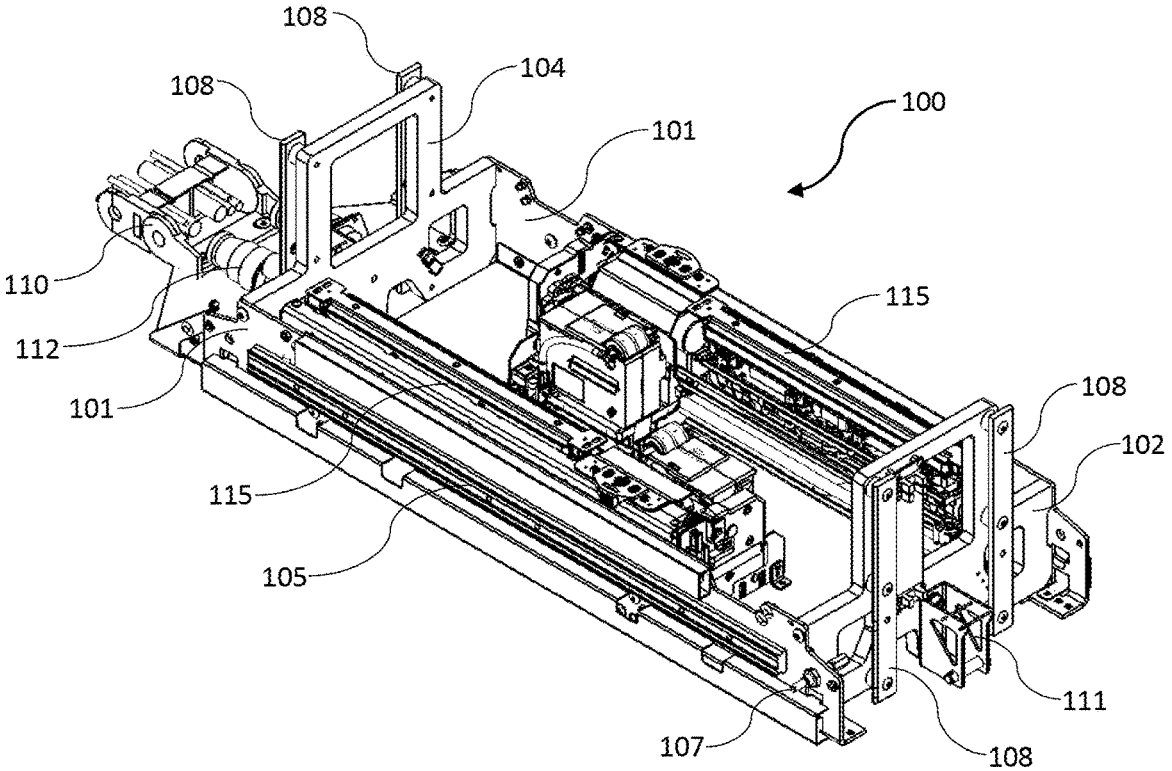
FIG. 8 is a perspective view of a maintenance chassis in isolation.

Still referring to FIG. 7, corner posts 56 extend upwardly from opposite ends of each of the base plates 52, with each of the four corner posts having an upper datum surface 58 for datuming the print bar chassis 200 in its printing position. Structural rigidity in the support chassis 50 is provided by elongate side plates 60 extending longitudinally between corner posts 56 of opposite base plates 52. Opposed drawer rails 62 are longitudinally mounted along each of the side plates 60 for sliding engagement with drawer slides 105 of the maintenance chassis 100 (FIG. 8). In addition, a pair of spittoon bars 64 extend longitudinally between the base plates 52, the spittoon bars being positioned between the notches 54 for alignment with respective printheads of the print bar chassis 200. Each spittoon bar 64 has a spittoon portion 66 for receiving spitted ink from a respective printhead. The spittoon bars 64 are height-adjustable via cam actuators 68 positioned on one of the base plates 52 and, together with the rollers 5, may be used to provide stability in the print zone during printing, as described in U.S. Provisional Application No. 62/563,584 filed 26 Sep. 2017, the contents of which are incorporated herein by reference.

Turning to FIG. 8, the maintenance chassis 100 takes the form of a drawer comprising a pair of longitudinal side panels 101 interconnected via front and rear end brackets 102 and 104. A drawer slide 105 is mounted to an outer surface of each of the side panels 101 for sliding engagement with the drawer rails 62 of the support chassis 50 to thereby form a sliding mechanism. The sliding mechanism may be locked for printing via a spring-loaded catch 107 extending outwardly from each of the side panels 101 and engaged with a complementary part of the support chassis 50. Release of the catch 107 allows the maintenance chassis 100 to slide rearwards or forwards relative to the support chassis 50, as described above in connection with FIGS. 5 and 6.

First and second maintenance modules 115 are affixed to opposed inner surfaces of the side panels. (Each maintenance module 115 is identical to the maintenance modules disclosed in U.S. Pat. No. 10,076,917 and is described in further detail hereinbelow). The first and second maintenance modules 115 are positioned for maintaining offset first and second printheads and are rotated 180 degrees relative to each other in order to minimize printhead spacing.

Each of the end brackets 102 and 104 has a pair of upwardly extending guide rails 108 fixedly mounted thereto, as well as a lower lift bracket 111 positioned centrally between the guide rails. The rear end bracket 104 additionally carries a cable support bracket 110 including a cable duct 112 for gathering various ink and electrical lines connected to the printheads.

As best shown in FIGS. 3 to 6, the lower lift bracket 111 supports a piston lift mechanism 113 extending between the maintenance chassis 100 and an upper lift bracket 202 of the print bar chassis. The piston lift mechanisms 113 at opposite ends of the inkjet module 10 are typically hydraulically-actuated via a common hydraulic system (not shown) for synchronous lifting and lowering of the print bar chassis 200. Whilst an hydraulic piston mechanism is shown herein, it will of course be appreciated that other lift mechanisms are within the ambit of the person skilled in the art e.g. wire-and-pulley mechanism, rack-and-pinion mechanism, scissor mechanism etc.

Figure 9:
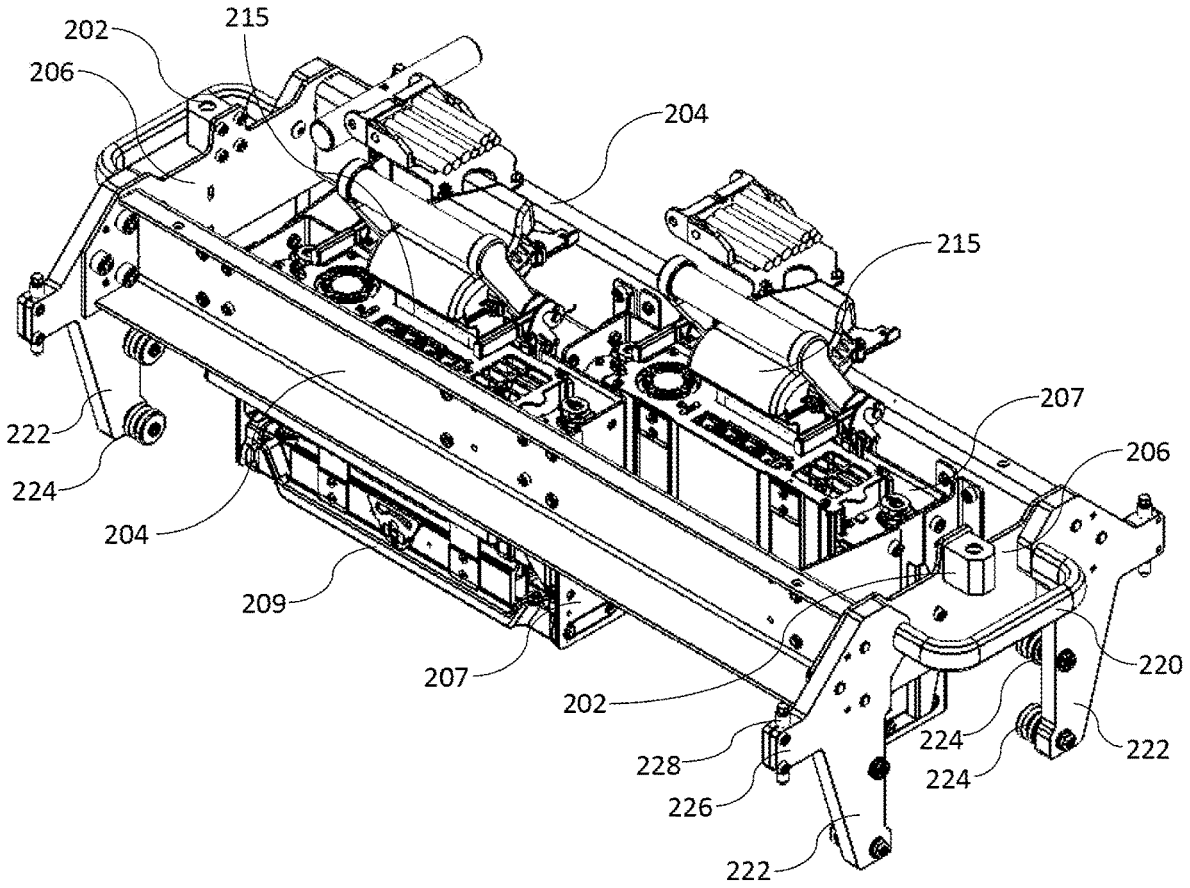
FIG. 9 is a perspective view of a print bar chassis in isolation.

Turning to FIG. 9, the print bar chassis 200 comprises an elongate frame having a pair of longitudinal mounting panels 204 extending between opposite end panels 206. First and second print modules 215 are mounted to the print bar chassis 200 via respective first and second print module carriers 207, the carriers being fixedly mounted to opposed inner surfaces of the mounting panels 204. Each print module 215 is slidably received in a respective print module carrier 207 and datumed against a lower nest portion 209 of the carrier. (Each print module 215 is identical to the print modules disclosed in U.S. Pat. No. 10,076,917 and is described in further detail hereinbelow). Although the embodiment described herein has a pair of print modules 215 (and corresponding maintenance modules 115), it will readily be appreciated that, in other embodiments, the print bar chassis 200 may comprise only one print module or three or more print modules in a staggered overlapping arrangement. Thus, the inkjet module 10 is may be configured for any required print width.

Still referring to FIG. 9, each end panel 206 of the print bar chassis 200 includes the upper lift bracket 202 for engagement with the piston lift mechanism 113; a handle 220 for manually sliding the print bar chassis and maintenance chassis 100 laterally away from the support chassis 50; and a pair of legs 222 extending downwardly towards the maintenance chassis 100. Each pair of legs 222 has opposed sets of rotatably-mounted roller bearings 224 (two in each set) engaged with opposite guide rails 108 of the maintenance chassis 100. Hence, the four sets of roller bearings 224 and corresponding guide rails 108, together with the piston lift mechanism 113, provide liftable mounting of the print bar chassis 200 relative to the maintenance chassis 100. Moreover, the roller bearings 224 are grooved for receiving part of each guide rail 108, thereby ensuring that the print bar chassis 200 is fast with the maintenance chassis 100 during lateral sliding movement away from the support chassis 50.

Each leg 222 additionally includes an outwardly projecting lug 226 with a height-adjustable pin 228 vertically screw-mounted on each lug (one pin in each corner of the print bar chassis 200). A lower surface of each pin 228 is engaged with a corresponding datum surface 58 of the support chassis 50 in the printing position (FIG. 3). Thus, the height-adjustable pins conveniently control the printhead-paper-spacing (PPS), as well as being adjustable in situ for different media thicknesses, once the inkjet module 10 is fixedly mounted on the roller shafts 7. The screw-mounted pins 228 may include calibrated detents for convenient adjustment of all four pins to an equal height. Advantageously, the pins 228 are maximally spaced in each inkjet module 10 in order to optimize alignment of multiple inkjet modules and provide accurate control of PPS, as well provide ready access for PPS adjustments.

Figure 10A:
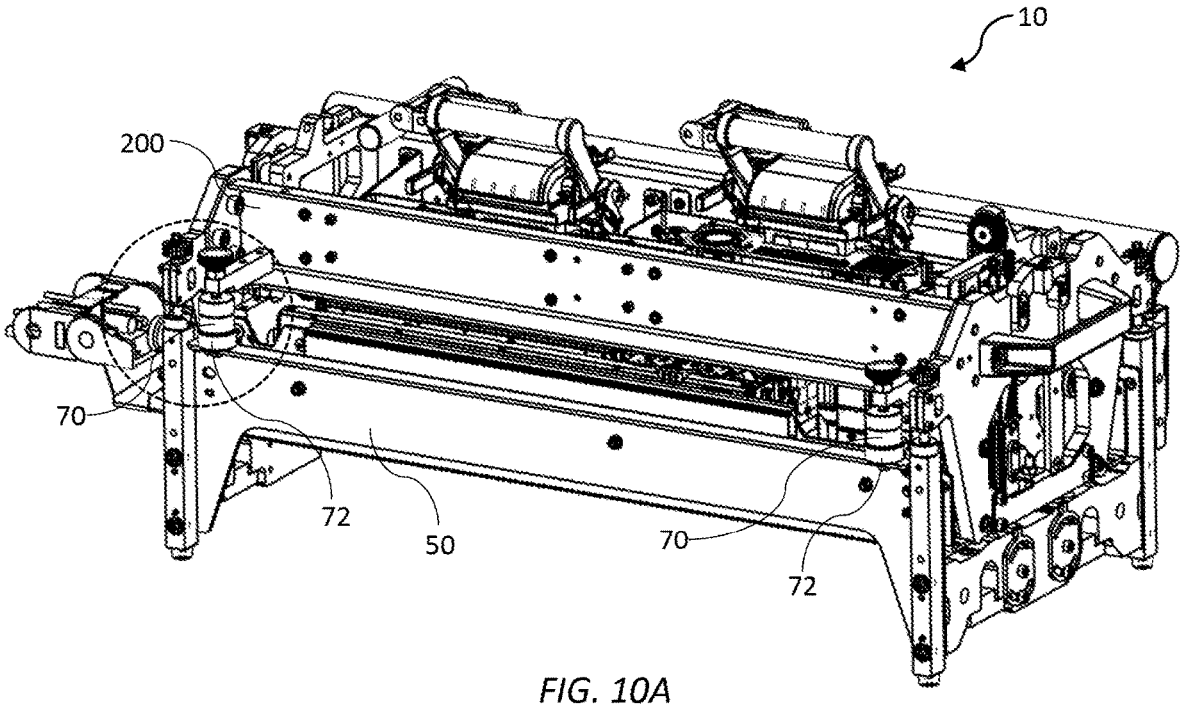
FIG. 10A is a perspective of an inkjet module according to an alternative embodiment.
Figure 10B:
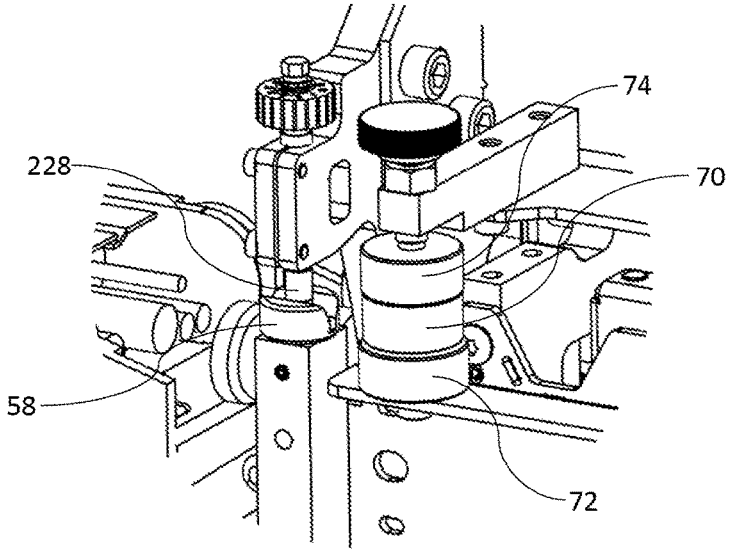
FIG. 10B is a magnified view of a magnet and datum arrangement shown in dotted outline in FIG. 10A.

Referring to FIGS. 10A and 10B, in an alternative embodiment, the print bar chassis 200 comprises a pair of magnets 70 for urging the print bar chassis into secure datumed engagement with the support chassis 50. Gentle lowering of the print bar chassis 200 is generally required by the lift mechanism in order to avoid excessive jolts, which potentially damage sensitive components in the inkjet module 10. However, at the end of its vertical travel the print bar chassis 200 still needs sufficient force to ensure each datum pin 228 is properly engaged with its corresponding datum surface 58. Without sufficient force, one or more datum pins 228 may not engage properly resulting in small, yet undesirable printing artifacts. Accordingly, a magnetic force towards the end of the vertical travel provides the necessary force for secure datuming. As best shown in FIG. 10B, each of a pair of rare-earth magnets 70 is adjustably mounted on the print bar chassis 200 for magnetically attracting a corresponding ferromagnetic (e.g. steel) pad 72 fixed to an upper surface of the support chassis 50. In the lowered position of the print bar chassis 200, the magnets 70 are spaced apart from the pads 72 with a typical separation of less than 2 mm or less than 1 mm. This separation provides sufficient attractive force to ensure that that all datum pins 228 are in secure datumed engagement with their corresponding datum surfaces 58 in the lowered position. Height-adjustable mountings 74 for the magnets 70 allow the optimum separation to be set in situ via a simple screw adjustment.

Print Module 215

Figure 11:
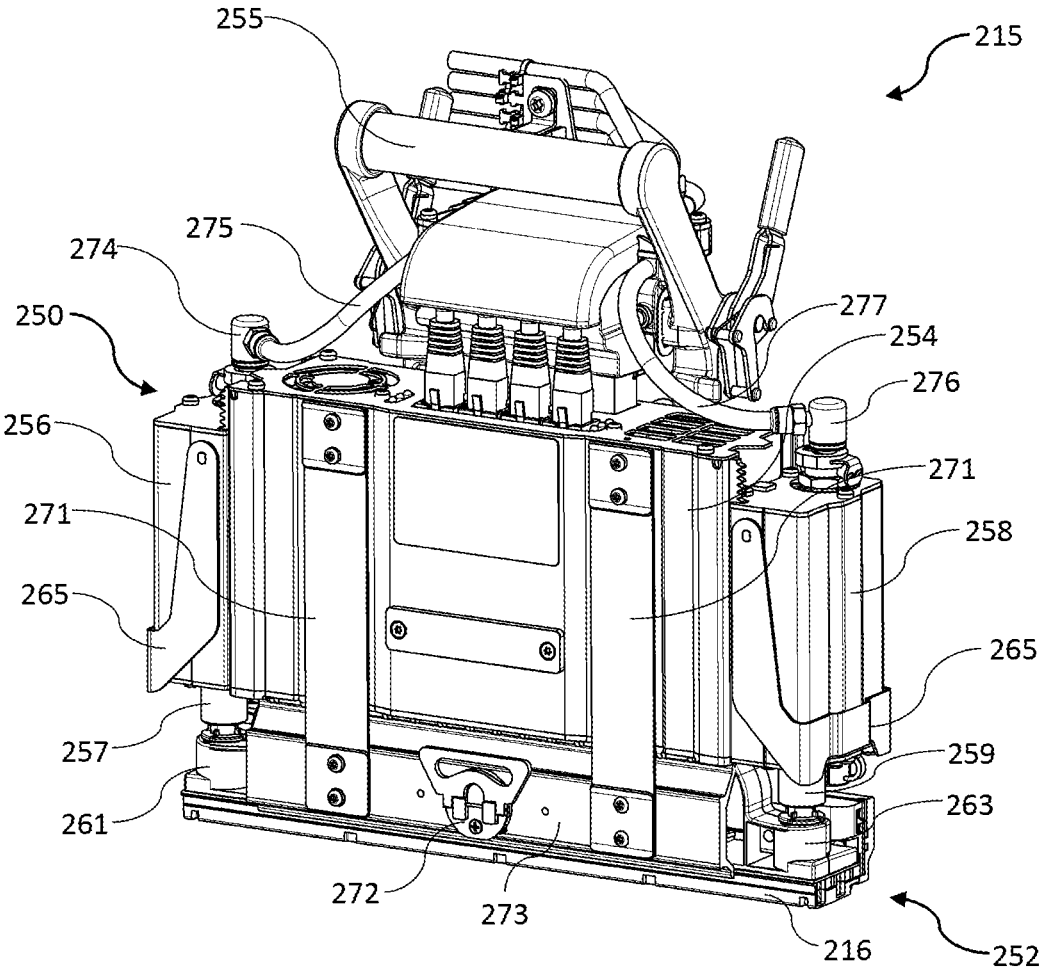
FIG. 11 is a perspective view of a print module.

For the sake of completeness, the print module 215 will now be described in further detail with reference to FIGS. 11 to 13. The print module 215 comprises a supply module 250 engaged with a replaceable printhead cartridge 252, which includes a printhead 216. The printhead cartridge 252 may be of a type described in, for example, U.S. Pat. No. 9,950,527, the contents of which are incorporated herein by reference.

The supply module 250 comprises a body 254 housing electronic circuitry for supplying power and data to the printhead 216. A print module handle 255 extends from an upper part of the body 254 to facilitate user removal and insertion into one of the print module carriers 207 of the print bar chassis 200.

The body 254 is flanked by an ink inlet module 256 and an ink outlet module 258 positioned on opposite sidewalls of the body. Each of the ink inlet and ink outlet modules has a respective ink coupling 257 and 259 engaged with complementary inlet and outlet couplings 261 and 263 of the printhead cartridge 252. The printhead cartridge 252 is supplied with ink from an ink delivery system (not shown) via the ink inlet module 256 and circulates the ink back to the ink delivery system via the ink outlet module 258.

The ink inlet module 256 and ink outlet module 258 are each independently slidably movable relative to the body 254 towards and away from the printhead cartridge 252. Sliding movement of the ink inlet and outlet modules 256 and 258 enables fluidic coupling and decoupling of the printhead cartridge 252 from the supply module 250. Each of the ink inlet and outlet modules 256 and 258 has a respective actuator in the form of a lever 265, which actuates sliding movement of the modules. Each lever 265 rotates about an axis perpendicular to the printhead 216 and is operatively connected to a pair of pinions 281. Rotation of the pinions 281 causes lateral sliding of movement of the inlet and outlet modules 256 and 258 relative to the body 254 via engagement with complementary racks 283 extending upwards and fixedly mounted relative to the body. This lever arrangement minimizes the overall width of the print module 215. As shown in FIGS. 11 and 13, the ink inlet module 256 and ink outlet module 258 are both lowered and the printhead cartridge 252 is fluidically coupled to the supply module 250. As shown in FIG. 12, the ink inlet and outlet modules 256 and 258 are both raised and the printhead cartridge 252 is fluidically decoupled from the supply module 250.

Figure 12:
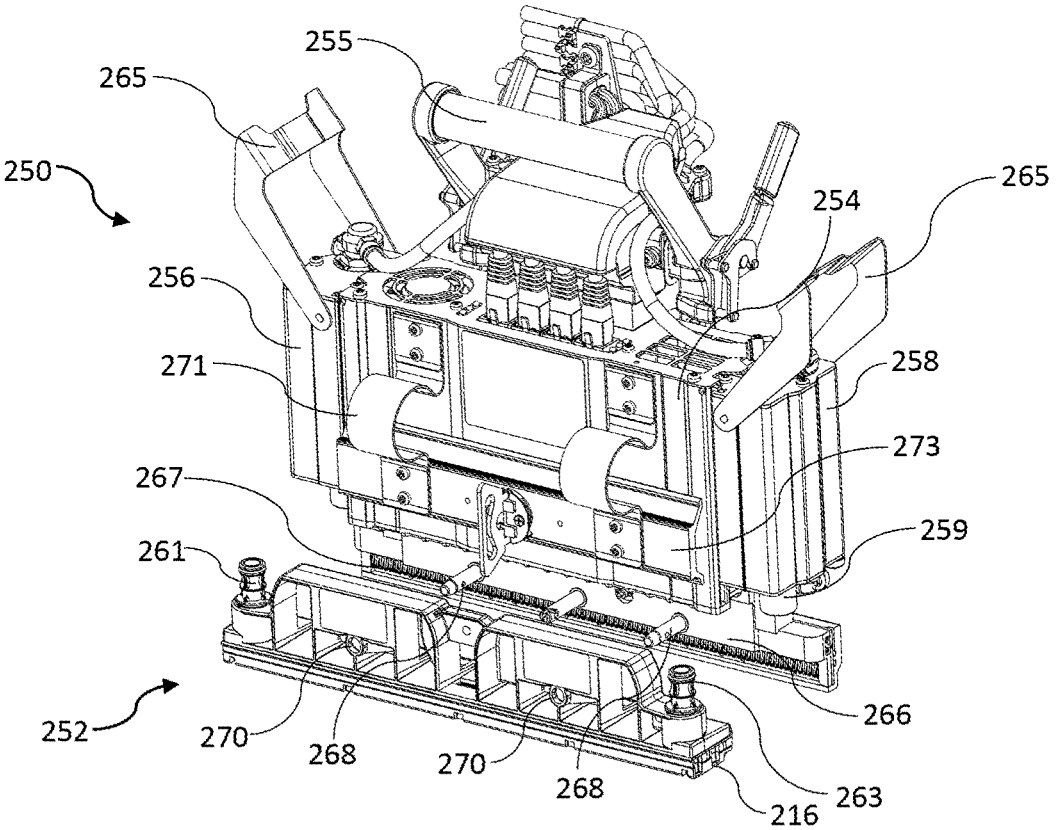
FIG. 12 is a perspective view of the print module with a printhead cartridge being decoupled.
Figure 13:
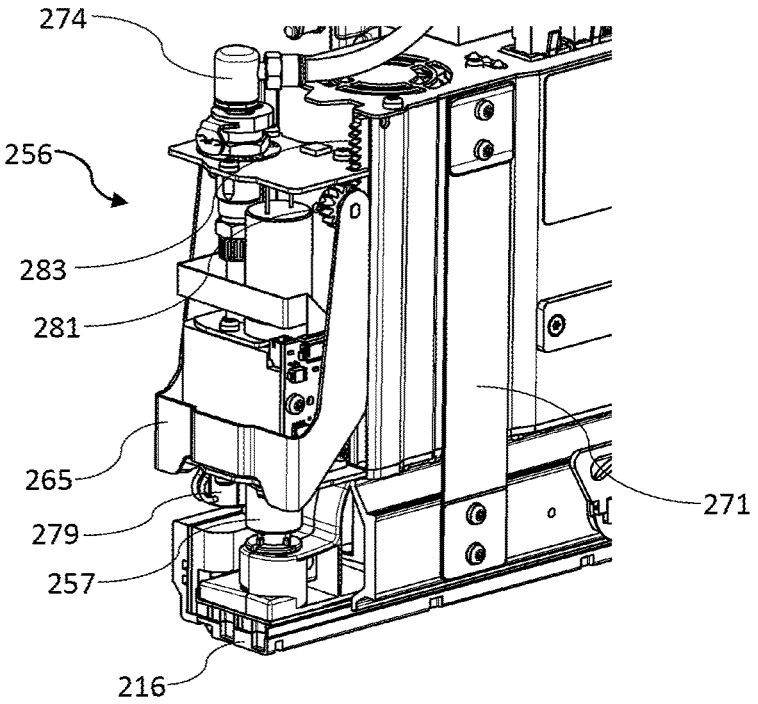
FIG. 13 shows an ink inlet module of the print module.

Still referring to FIG. 12, the supply module 250 has a clamp plate 266 extending from a lower part of the body 254. The lower part of the body 254 additionally has a row of electrical contacts 267 for supplying power and data to the printhead 216 via a complementary row of contacts (not shown) on the printhead cartridge 252 when the printhead cartridge is coupled to the supply module 250.

A set of locating pins 268 extend from the clamp plate 266 perpendicularly with respect to a sliding movement direction of the ink inlet and outlet modules 256 and 258. In order to install the printhead cartridge 252, each locating pin 268 is aligned with and received in a complementary opening 270 defined in the printhead cartridge 252. The printhead cartridge 252 is slid in the direction of the locating pins 268 towards the clamp plate 266. Once the printhead cartridge 252 is engaged with the clamp plate 266, a hinged clamp 273, connected to the body 254 via hinges 271, is swung downwards to clamp the printhead cartridge 252 against the clamp plate. The printhead cartridge 252 is locked in place by a fastener 272 on the hinged clamp 273. Finally, the ink inlet and outlet modules 256 and 258 are slid downwards via actuation of the levers 265 to fluidically couple the printhead cartridge 252 to the supply module 250. The reverse process is used to remove the printhead cartridge 252 from the supply module 252. The manual removal and insertion process, as described, can be readily and cleanly performed by users within a matter of minutes and with minimal loss of downtime in a digital press.

The ink supply module 256 is configured for receiving ink at a regulated pressure from an inlet line of an ink delivery system (not shown). A suitable ink delivery system for use in connection with the print modules 215 employed in the present invention is described in US 2017/0313096, the contents of which are incorporated herein by reference. The ink inlet module 256 has an inlet port 274 for receiving ink from an ink reservoir (not shown) via an inlet line 275, while the ink outlet module 258 has an outlet port 276 for returning ink to the ink reservoir via an outlet line 277.

The ink inlet and outlet modules 256 and 258 independently house various components for providing local pressure regulation at the printhead 216, dampening ink pressure fluctuations, enabling printhead priming and de-priming operations, isolating the printhead for transport etc. In FIG. 13, the ink inlet module 256 is shown with a cover removed to reveal certain components of the ink inlet module. For example, there is shown a control PCB 278 having an ink pressure sensor and a microprocessor, which provides feedback to a control valve 279 for controlling a local pressure at the printhead 216. It will be appreciated that these and other components may be housed in the ink inlet and outlet modules 256 and 258.

Maintenance Module 115

For the sake of completeness, the maintenance module 115 will now be described in further detail with reference to FIGS. 14 and 15. Each maintenance module 115 is fixedly mounted to the maintenance chassis 100 and defines a space through which a respective print module 215 can extend and retract between a printing position and a maintenance position, respectively. Accordingly, in the printing position, each printhead 216 is positioned at a suitable spacing from a media web supported by the rollers 5 of the media feed chassis 3.

Figure 14:
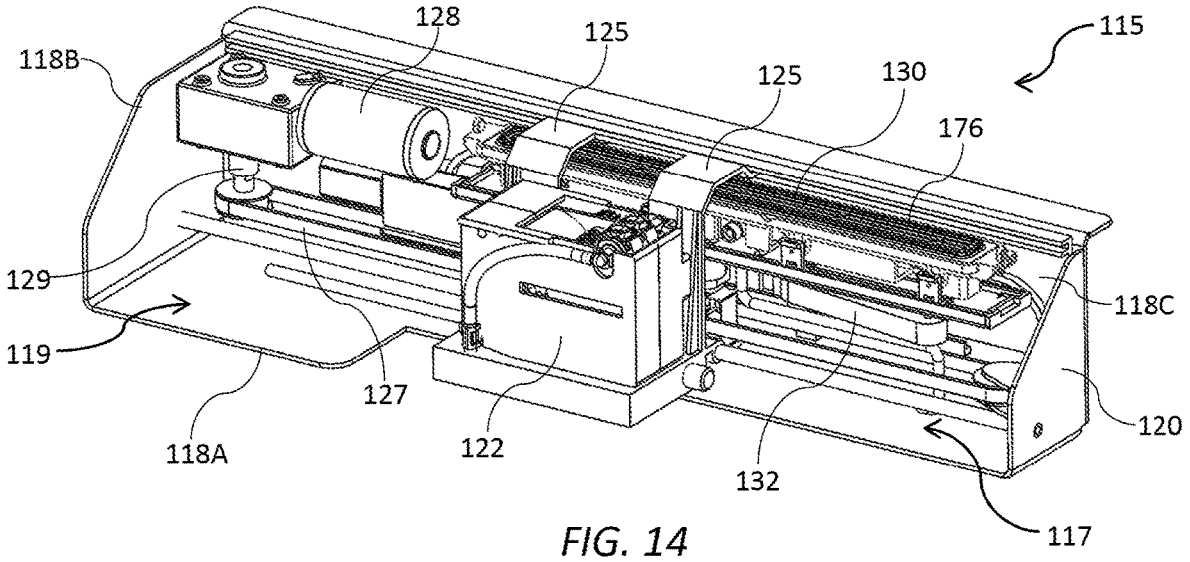
FIG. 14 is a perspective view of a maintenance module during wiping.
Figure 15:
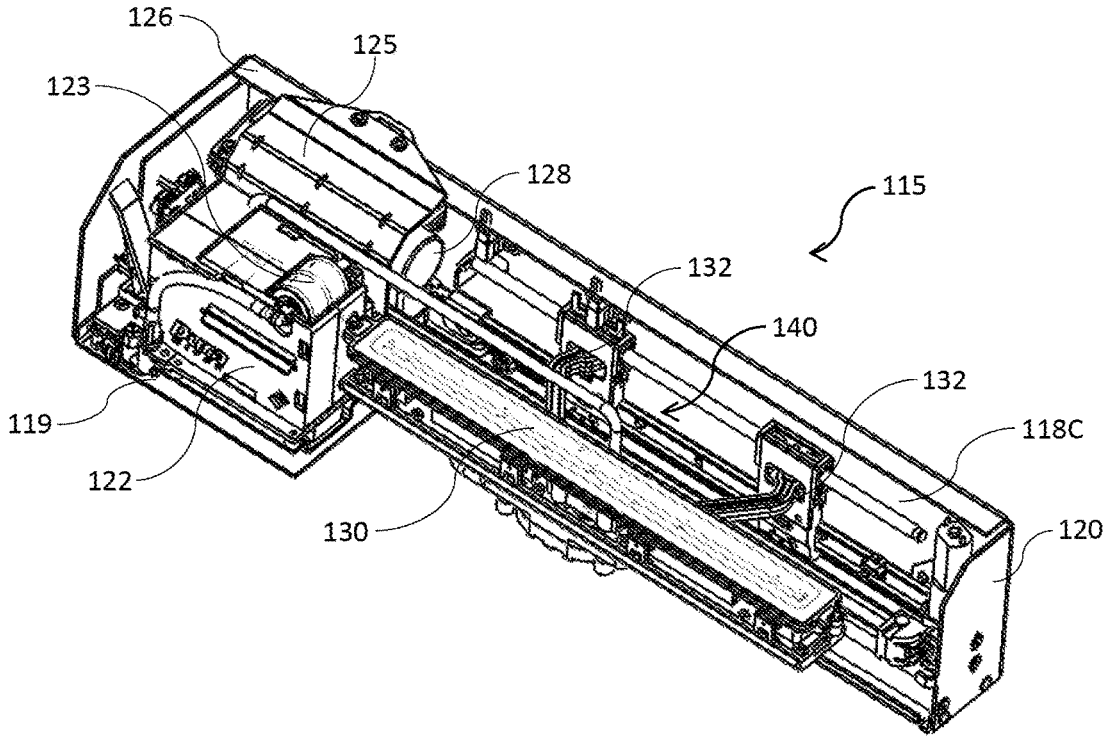
FIG. 15 is a perspective view of a maintenance module during capping.

Referring to FIGS. 14 and 15, each maintenance module 115 has a generally L-shaped frame 120, which is arranged to wrap around two sides of its respective print module 215. The L-shaped frame 120 has a longer leg 117 extending parallel with one length dimension of the print module 215 and one shorter leg 119 extending parallel with a width dimension of the print module. The L-shaped frame 120 of each maintenance module 115 enables a compact arrangement of the maintenance modules.

The L-shaped frame 120 of the maintenance module 115 comprises a base plate 118A with a shorter side plate 118B and a longer side plate 118C extending upwards therefrom. The shorter leg 119 comprises the shorter side plate 118B and a corresponding part of the base plate 118A; the longer leg 117 comprises the longer side plate 118C and a corresponding part of the base plate 118A. The L-shaped frame 120 houses a wiper 122 for wiping a respective printhead 216 and a capper 130 for capping the printhead.

As shown in FIG. 14, the wiper 122 is in its home or parked position, whereby the wiper is positioned within the shorter leg 119 of the L-shaped frame 120. As shown in FIG.

15, the capper 130 is in its home or parked position, whereby the capper is positioned within the longer leg 117 of the L-shaped frame 120.

The wiper 122 is of a type having a wiping material 123 (shown in FIG. 14) mounted on a carriage 124, which moves longitudinally along a length of the print module 215 to wipe the printhead 216. The carriage 124 is supported by one or more overhead arms 125, which are slidingly engaged in a carriage rail 126 fixed to the longer side plate 118C and extending along the longer arm 119 of the frame 120. In FIG. 14, the carriage 124 has moved from its home position and is partway through a longitudinal wiping operation. In FIG. 14, the capper is in its parked position and it can be seen that the overhead arms 125 bridge over the capper 130 during the wiping movement of the carriage 124. The carriage 124 is traversed by means of a first endless belt 127 driven by a bidirectional carriage motor 128 and belt drive mechanism 129.

The capper 130 is mounted to the longer side plate 118C of the L-shaped frame 120 via a pair of hinged arms 132, which laterally extend and retract the capper into and away from a space occupied by the printhead 216 by means of a suitable retraction mechanism 140. The capper 130 is shown in its capping position in FIG. 15 with both arms 132 extended, while the wiper 122 is parked in its home position.

For capping operations, the print bar chassis 200 is lifted from the maintenance chassis 100 and raised initially into a transition position. With the print bar chassis 200 in its highest transition position, each capper 130 is extended, and the print bar chassis 200 then gently lowered to the maintenance position such that the each printhead 216 is capped by a perimeter seal 176 of its respective capper. The reverse process configures the print engine 1 back into the printing position.

Similarly, for wiping operations, the print bar chassis 200 is lifted from the maintenance chassis 100 and raised initially into a transition position. With the print bar chassis 200 in its highest transition position, each wiper 122 is moved beneath its respective printhead 216 and the print bar gently lowered into the maintenance position so that the wipers are engaged with their respective printheads. Typically, the wiping material 123 is resiliently mounted to allow a generous tolerance when the print bar chassis 200 is lowered. Once the wiper 122 engaged with the printhead 216, the carriage 124 is traversed lengthwise along the printhead to wipe ink and/or debris from the nozzle surface of the printhead.

From the foregoing, it will be appreciated that the present invention enables inkjet modules to be arranged in a relatively low-cost modular printing system, which minimizes integration, development and commercialization costs for OEMs whilst allowing versatility with respect to the number and arrangement of inkjet modules.

It will, of course, be appreciated that the present invention has been described by way of example only and that modifications of detail may be made within the scope of the invention, which is defined in the accompanying claims.

The invention claimed is:

1. An integrated inkjet module comprising:
- a support chassis configured for fixedly mounting on a media feed chassis;
- a maintenance chassis slidably mounted on the support chassis; and
- a print bar chassis liftably mounted on the maintenance chassis, the print bar chassis having one or more inkjet printheads mounted thereon, wherein the support chassis has a base defining notches configured for mounting the inkjet module on fixed roller shafts of the media feed chassis.

2. The inkjet module of claim 1, wherein each notch has a respective clamp for clamping the support chassis fast with the roller shafts.

3. The inkjet module of claim 1, wherein the support chassis comprises one or more spittoons for receiving spitted ink from the printheads.

4. The inkjet module of claim 1, wherein the support chassis comprises a plurality of datums for datuming against the print bar chassis.

5. The inkjet module of claim 4, wherein the print bar chassis comprises a plurality of pins projecting towards the datums of the support chassis.

6. The inkjet module of claim 5, wherein the pins are height-adjustable.

7. The inkjet module of claim 1, wherein the print bar chassis is fast with the maintenance chassis in a slide direction of the maintenance chassis.

8. The inkjet module of claim 1, wherein the maintenance chassis comprises one or more maintenance modules corresponding to the one or more printheads of the print bar chassis.

9. The inkjet module of claim 1, wherein the maintenance chassis is mounted to the support chassis via a bidirectional slide mechanism.

10. The inkjet module of claim 9, wherein the maintenance chassis comprises a catch for locking the maintenance chassis and print bar chassis in a printing position.

11. The inkjet module of claim 9, wherein the print bar chassis is fast with the maintenance chassis in a slide direction of the maintenance chassis.

12. The inkjet module of claim 9, wherein the print bar chassis comprises a handle for effecting sliding movement of the maintenance chassis.

13. A printing system comprising:
- a media feed chassis; and
- one or more inkjet modules according to claim 1 mounted on the media feed chassis.

14. An integrated inkjet module comprising:
- a support chassis configured for fixedly mounting on a media feed chassis;
- a maintenance chassis slidably mounted on the support chassis; and
- a print bar chassis liftably mounted on the maintenance chassis, the print bar chassis having one or more inkjet printheads mounted thereon, wherein the support chassis comprises one or more spittoons for receiving spitted ink from the printheads.

15. An integrated inkjet module comprising:
- a support chassis configured for fixedly mounting on a media feed chassis;
- a maintenance chassis slidably mounted on the support chassis; and
- a print bar chassis liftably mounted on the maintenance chassis, the print bar chassis having one or more inkjet printheads mounted thereon, wherein the maintenance chassis is mounted to the support chassis via a bidirectional slide mechanism and the maintenance chassis comprises a catch for locking the maintenance chassis and print bar chassis in a printing position.

* * * * *